US005396204A

United States Patent [19]

Matsuoka et al.

[11] Patent Number: 5,396,204

[45] Date of Patent: Mar. 7, 1995

[54] ELECTROMAGNETIC RELAY

[75] Inventors: Kazushige Matsuoka; Masato Kouzaki, both of Kyoto, Japan

[73] Assignee: Omron Corporation, Kyoto, Japan

[21] Appl. No.: 133,002

[22] PCT Filed: Apr. 9, 1992

[86] PCT No.: PCT/JP92/00443

§ 371 Date: Oct. 8, 1993

§ 102(e) Date: Oct. 8, 1993

[87] PCT Pub. No.: WO92/19000

PCT Pub. Date: Oct. 29, 1992

[30] Foreign Application Priority Data

| | | | |
|---|---|---|---|
| Apr. 9, 1991 | [JP] | Japan | 3-023090 U |
| Apr. 23, 1991 | [JP] | Japan | 3-028033 U |
| May 7, 1991 | [JP] | Japan | 3-030946 U |

[51] Int. Cl.[6] ..... H01H 51/22

[52] U.S. Cl. ..... 335/78; 335/801

[58] Field of Search ..... 335/78–86, 335/128, 129, 130, 131, 202

[56] References Cited

U.S. PATENT DOCUMENTS

| | | | |
|---|---|---|---|
| 4,618,842 | 10/1986 | Nestlen et al. | 335/128 |
| 5,041,870 | 8/1991 | Imai et al. | 335/78 |
| 5,160,910 | 11/1992 | Tsuji | 335/129 |

FOREIGN PATENT DOCUMENTS

| | | |
|---|---|---|
| 0463884 | 1/1992 | European Pat. Off. . |
| 2294533 | 12/1975 | France . |
| 521019 | 5/1972 | Germany . |
| 52-45161 | 3/1977 | Japan . |
| 61-120154 | 7/1986 | Japan . |
| 61-151939 | 7/1986 | Japan . |
| 63-137431 | 9/1988 | Japan . |
| 64-9698 | 2/1989 | Japan . |
| 2167902 | 11/1984 | United Kingdom . |
| 2167902A | 6/1986 | United Kingdom . |

OTHER PUBLICATIONS

International Search Report, by Japanese Patent Office, dated Jul. 7, 1992.

English Translation of International Search Report dated Jul. 7, 1992.

International Preliminary Examination Report dated Jan. 26, 1993.

*Primary Examiner*—Lincoln Donovan

*Attorney, Agent, or Firm*—Fish & Richardson

[57] ABSTRACT

In an electromagnetic relay having a movable piece (30) supported so as to be free to oscillate, an electromagnet block (20) for attracting and oscillatingly displacing the movable piece by being excited, a contact mechanism having a movable contactor (53) and a fixed contactor (51, 52), a slide card (60) connecting a free end of the movable piece and the movable contactor, and a housing comprising a base (10) and a case (70), a supporting projection (71) is formed on the inner surface of the case (70) and the projection comes into abutting contact with the upper surface of a frame (11) of the base, thereby assuring a space within which the slide card may move. The slide card is formed to have a hole (61) so that the card will avoid the supporting projection.

8 Claims, 14 Drawing Sheets

ELECTROMAGNETIC RELAY

TECHNICAL FIELD

This invention relates to an electromagnetic relay and, more particularly, to an electromagnetic relay of the type in which the displacement of a movable iron element oscillatingly driven by an electromagnet block is transmitted to a movable contactor by a connecting member referred to as a slide card.

BACKGROUND ART

An electromagnetic relay of this type is known in which a long insulating distance of small height is capable of being obtained, as set forth in the specification of British Patent No. 2167902.

More specifically, as shown in FIGS. 24 and 25, an electromagnet block 3 is housed within a box-shaped case 1, and an L-shaped movable iron element 5 is turnably supported via a hinge spring 4 fixed to a yoke 3*a* included in the electromagnet block 3. The interior of the case 1 is divided by a partitioning wall 1*a* into a compartment in which the electromagnet block 3 is accommodated and a compartment in which a contact mechanism is accommodated. The contact mechanism is composed of a movable contactor 7 having a movable contact 7*a*, and a fixed contactor 8 having a fixed contact 8*a*. The movable iron element 5 and the movable contactor 7 are connected by a card 6 that is capable of sliding movement. In order to insulate the electromagnet block 3 from the movable contactor 7 and fixed contactor 8, an insulating member 9 is attached to the compartment of the electromagnet block 3. A base 2 is fitted on the case 1.

When the movable iron element 5 is turned by excitation of the electromagnet block 3, one end of the movable iron element 5 pushes one end face of the card 6, and the card 6 thus pushed presses the free end of the movable contactor 7, whereby the latter is flexed. As a result, the movable contact 7*a* contacts the fixed contact 8*a*.

In the electromagnetic relay of this type, however, the card 6 is situated in close proximity to the base 2. Consequently, a problem encountered is that if the base 2 is deformed by an external force or as the result of thermal expansion, the sliding movement of the card 6 will be impeded and faulty operation will occur.

In the electromagnetic relay constructed as set forth above, the card 6 has a slender, elongated shape in order to assure a long insulating distance between the contacts 7, 8 and the movable iron element 5. As a consequence, the card 6 is easily deformed and the operating characteristic of the electromagnetic relay changes easily owing to curvature of the card 6 or thermal expansion.

Moreover, wear fragments are produced from one end portion of the card owing to sliding contact between the card 6 and movable contactor 7, and there is the danger that the wear fragments give rise to faulty contact.

A further problem is that in a case where a large current flows into the movable contactor 7, the card is readily melted by heat produced by the movable contactor 7. This is hazardous.

In an electromagnetic relay of the foregoing construction, the insulating member 9, which is separate from the case 1, must be installed in the compartment of the electromagnet block 3 in order to assure the long insulating distance, as set forth above. As a result, there are a large number of component parts and a large number of assembly steps. Moreover, since an adjustment operation must be performed after the internal components such as the electromagnet block 3 are installed in the box-shaped case 1, locations at which the adjustments can be made are limited and productivity is low because labor is involved in performing the adjustment operation.

Disclosure of the Invention

An object of the present invention is to provide an electromagnetic relay in which faulty operation will not occur owing to deformation of the housing.

Another object of the present invention is to provide an electromagnetic relay, which has a stable operating characteristic, in which faulty contact and melting of the card will not occur.

Another object of the present invention is to provide an electromagnetic relay exhibiting a high productivity owing to a small number of component parts and an adjustment operation that is easy to perform.

According to the present invention, an electromagnetic relay having a movable piece supported so as to be free to oscillate, an electromagnet block for attracting and oscillatingly displacing the movable piece by being excited, a contact mechanism having a movable contactor and a fixed contactor, a connecting member connecting a free end of the movable piece and the movable contactor, and a housing for internally accommodating each of the foregoing elements is characterized in that one of a face of the housing and a partial face of any element accommodated within the housing, which faces oppose each other with the connecting member interposed between them in spaced relation thereto, is formed to have a supporting projection that is in abutting contact with the other face, and the connecting member is formed to have such a shape that, despite movement thereof, it will avoid the supporting projection without contacting the supporting projection.

In accordance with the present invention, therefore, the supporting projection acts to suppress deformation of the housing even if part of the housing is about to undergo deformation owing to an external force or thermal expansion. As a result, movement of the connecting member (a slide card) is not impeded by a deformed housing and, hence, faulty operation does not occur.

According to the present invention, an electromagnetic relay having a movable piece supported so as to be free to oscillate, an electromagnet block for attracting and oscillatingly displacing the movable piece by being excited, a contact mechanism having a movable contactor and a fixed contactor, and a slide card connecting a free end of the movable piece and the movable contactor, characterized in that an engaging fitting for connecting the slide card to the movable contactor is provided on one end of the slide card.

In accordance with the present invention, therefore, the card drives the movable contactor via the engaging fitting provided on one end of the card. That is, since the engaging fitting drives the movable contactor directly, wear fragments are not produced from the card, as occurs in the example of the prior art, and faulty contact does not occur.

Further, even if a large current flows into the movable contactor, the card will not be melted by heat produced by the movable contactor, as occurs in the example of the prior art, owing to the high melting point of the engaging fitting. This provides safety and improves reliability.

Preferably, the slide card is made of synthetic resin and the engaging fitting is secured to the slide card by insert molding. Owing to the insert molding of the engaging fitting, the card itself does not readily undergo deformation, and a change in operating characteristics due to curvature of the card or thermal expansion can be prevented.

An electromagnetic relay according to the present invention has a base provided with a frame one end face of which is open and another end face of which is closed by an insulating wall, an electromagnet block fixedly accommodated with a space formed within the frame, a movable element supported, so as to be free to oscillate, on the one end face of the frame that is open and attracted by excitation of the electromagnet block, a contact mechanism attached to said base outwardly of the insulating wall and having a movable contactor and a fixed contactor, and a connecting member connecting a free end of the movable piece and the movable contactor.

In accordance with the present invention, the electromagnet block is accommodated within the frame one end face of which is closed by the insulating wall. This makes it unnecessary to install a separate insulating member, as is done in the electromagnetic relay of the prior art. As a result, there are fewer component parts and the number of assembly steps is reduced. Moreover, since almost all of the movable parts such as the movable element and connecting member are exposed within the housing, an adjusting operation does not require labor and productivity is improved.

Other features of the present invention will become clear in the description of the embodiment with reference to the drawings.

BEST MODE FOR CARRYING OUT THE INVENTION

Figure 1:
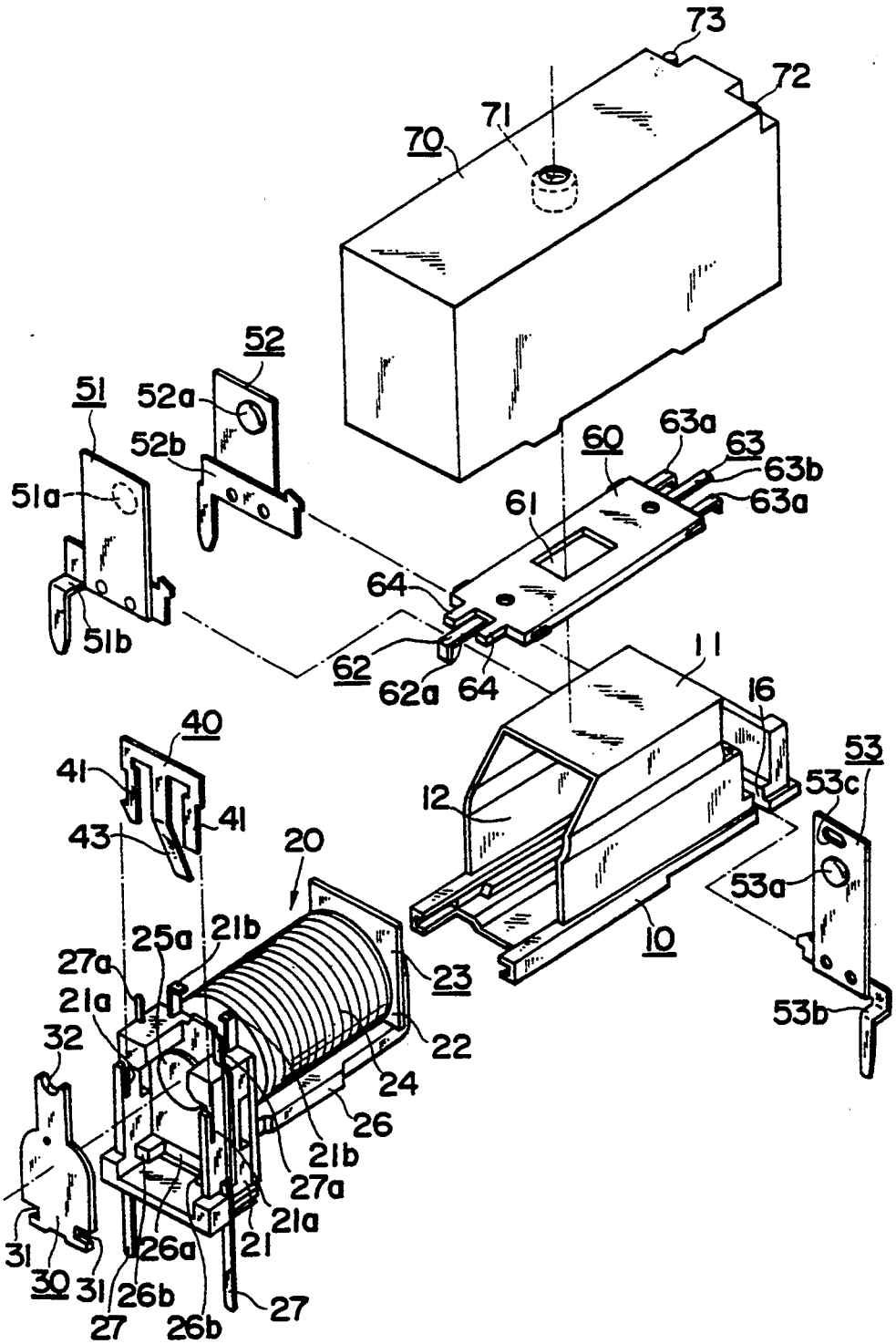
FIG. 1 is an exploded perspective view illustrating an electromagnetic relay of an embodiment of the present invention.
Figure 2:
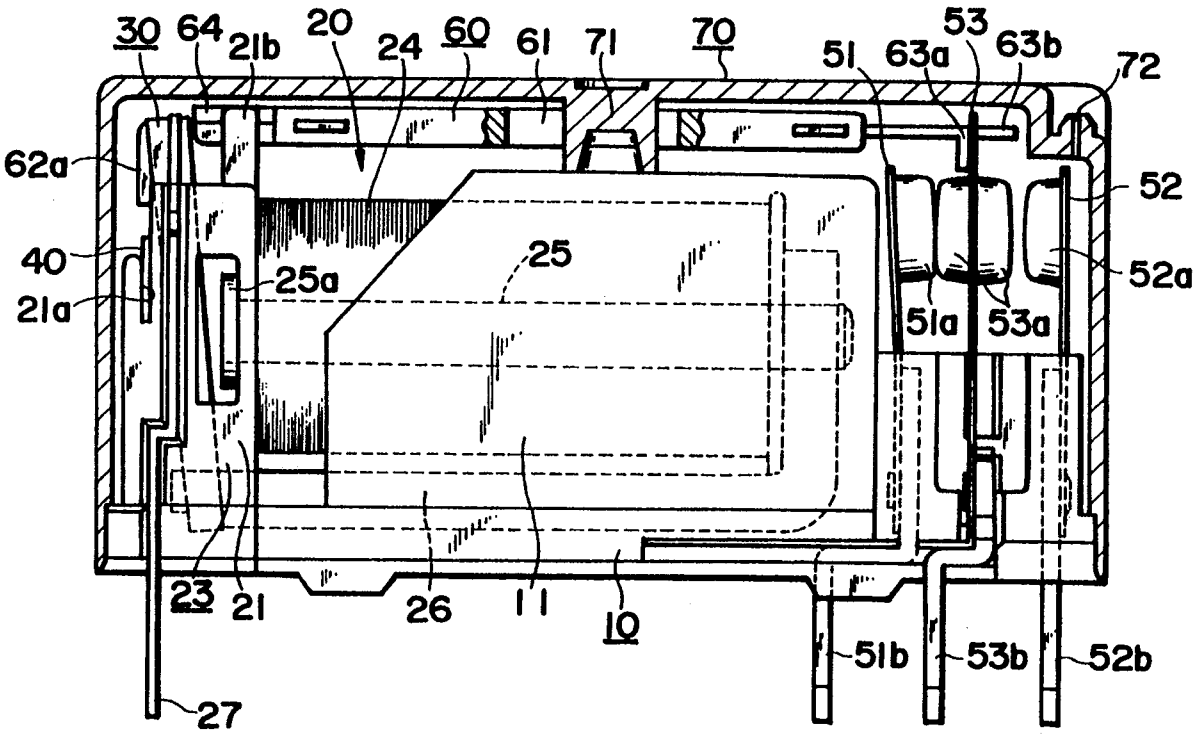
FIG. 2 is a sectional view of the electromagnetic relay.

FIG. 1 is an exploded perspective view illustrating an electromagnetic relay of an embodiment of the present invention, and FIG. 2 is an enlarged sectional view of the same.

Overall, the electromagnetic relay is composed of a base 10, an electromagnet block 20 including a movable iron element 30 and a hinge spring 40, a contact mechanism including fixed contactors 51, 52 and a movable contactor 53, a slide card 60 connecting a movable iron element 30 and the movable contactor 53 of the contact mechanism, and a case 70 covering the entirety of these components.

The details of these components will be described below.

Figure 3:
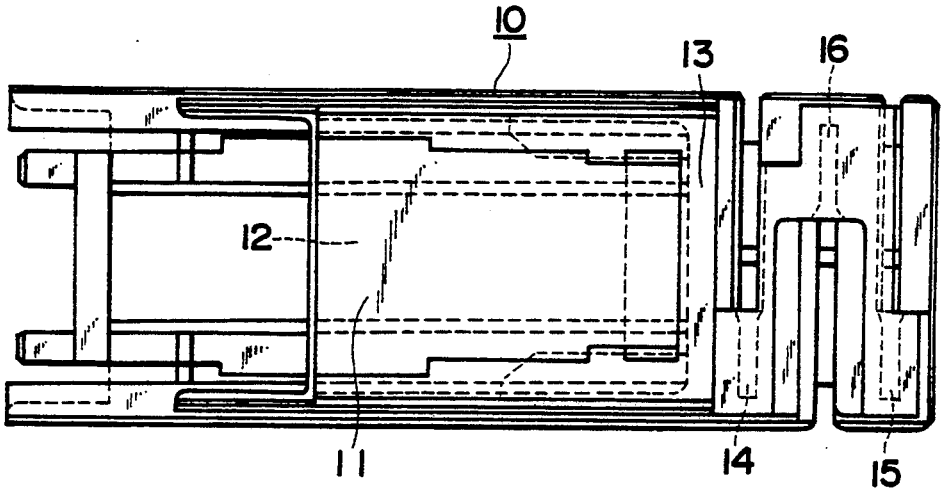
FIG. 3 is a plan view of a base.
Figure 4:
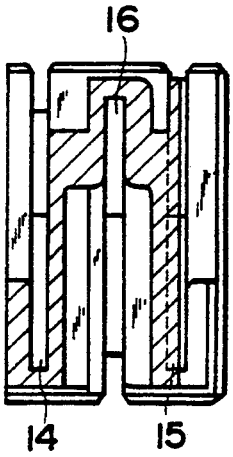
FIG. 4 is a transverse sectional view of part of the base.

FIGS. 3 and 4 illustrate the base 10 in enlarged form. The base 10 is equipped with a frame 11 covering the upper surface of the base as well as both side surfaces thereof. One end face of the frame 11 is opened and the other end face is closed by an insulating wall 13. The interior of the frame 11 defines a space 12. Furthermore, press-fitting grooves 14, 15 and 16 for securing the fixed contactors 51, 52 and the movable contactor 53 are formed in the base 10 outwardly of the insulating wall 13. The grooves 14~16 are parallel to one another, with the central groove 16 having its opening in one side of the base 10 and the grooves 14, 15 on both sides thereof having their openings in the other side of the base 10. The base 10 preferably is integrally molded of an insulative synthetic resin so as to include the frame 11 and insulating wall 13.

The electromagnet block 20 includes a spool 23, a coil 24, a core 25, a yoke 26 and the above-mentioned movable iron piece 30 and hinge spring 40. The spool 23 is composed of a cylindrical portion and flanges 21, 22 formed on the two ends of thereof. The coil 24 is wound upon the periphery of the cylindrical portion. The core 25 is passed through a through-hole formed in the cylindrical portion of the spool 23. A head portion **25*a* having a large diameter is formed on one end of the core 25, and the head portion 25*a* is exposed to the outside at the central portion of the flange 21. When the electromagnetic block is excited, a magnetic pole appears at the head portion 25*a* and the movable iron element 30 is attracted. The head portion 25*a* is referred to as a magnetic pole portion. The other end of the core 25 is inserted into a hole 26B (see FIGS. 5 and 6), which is formed in an upstanding portion 26A of the yoke 26, and is secured to the yoke 26** by caulking.

The front face of the flange 21 of the spool 23 is formed to have a wall whose two sides and lower end project forwardly. The walls on the two sides are each formed to have a slit **21*a* for securing the hinge spring 40, and the upper parts of the walls are provided with guide projections 21*b* whose upper ends are bent inwardly into an L-shaped configuration. Coil terminals 27 are secured to the walls on both sides of the flange 21 by being press fitted from the sides of the flange, and lead wires of the coil 24 are soldered to the upper end portions 27***a* of the coil terminals.

Figure 5:
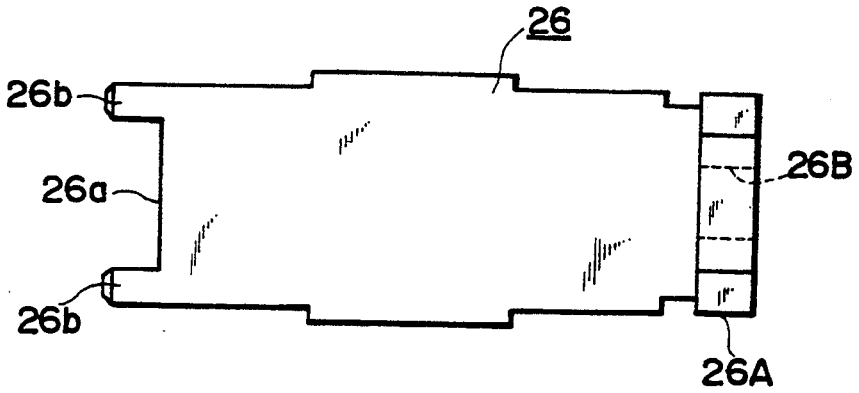
FIG. 5 is a plan view of a yoke.
Figure 6:
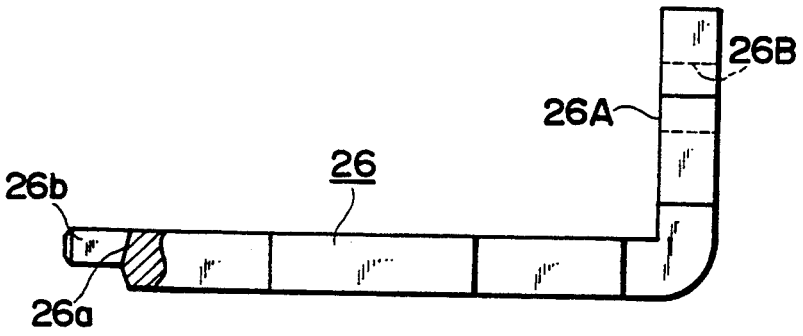
FIG. 6 is a partially cut-away side view of the yoke.

The details of the yoke 26 are illustrated in FIGS. 5 and 6. Supporting projections 26*b* are formed on both sides of an end face 26*a* on the side opposite the upstanding portion 26A of the yoke 26, and the projections 26*b* protrude from the front face of the flange 21 of spool 23.

Figure 7:
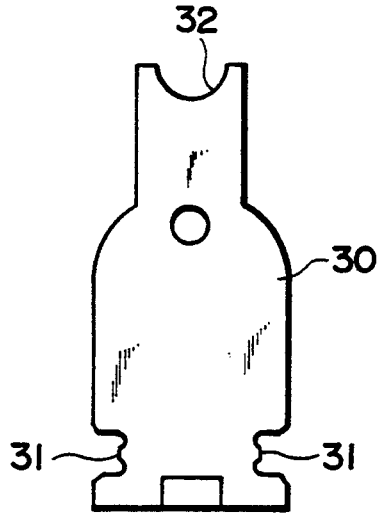
FIG. 7 is a front view of a movable iron element.
Figure 8:
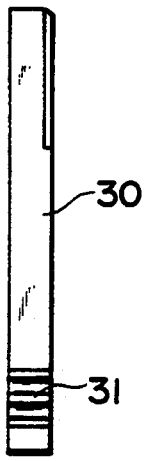
FIG. 8 is a side view of the movable iron element.

The details of the movable iron element 30 are depicted in FIGS. 7 and 8. The movable iron element 30 has such a shape that allows it to fit into the central portion of the front face of flange 21 on spool 23, and cut-outs 31 engaged by the above-mentioned supporting projections 26*b* of the yoke 26 are formed in the two sides of the movable iron element 30 at the lower part thereof. Further, the upper end of the movable iron element 30 is formed to have a semicircular cut-out 32.

Figure 9:
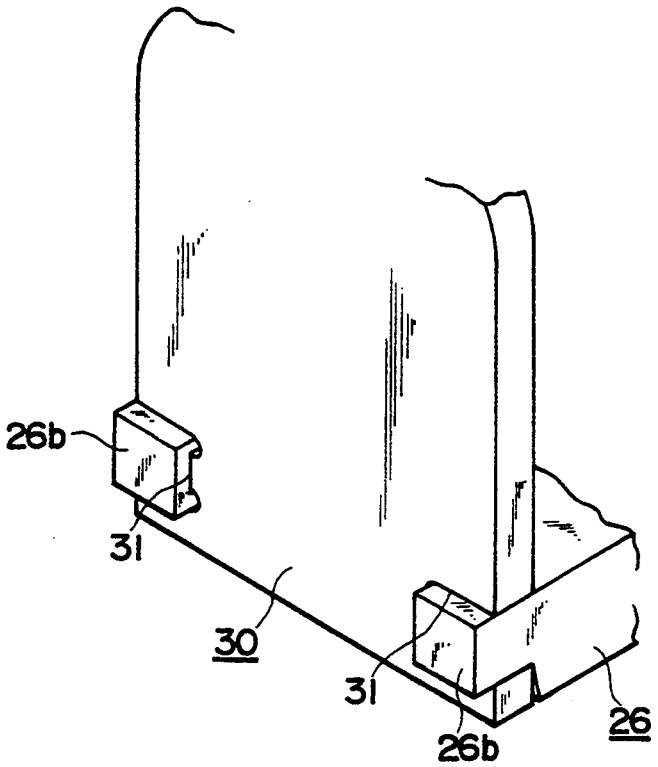
FIG. 9 is a perspective view showing the movable iron element in a state in which it is installed in the yoke.

As illustrated in FIG. 9, the movable iron element 30 is held, so as to be free to oscillate slightly, by engaging the supporting projections 26*b* of the yoke 26 with the cut-outs 31*a* of the iron element. In this state the movable iron element 30 opposes, center to center, the magnetic pole portion 25*a* of the core 25.

The hinge spring 40, which is obtained by forming a spring member having the shape of a thin plate into a generally E-shaped configuration, has mounting pieces 41 on both sides and a somewhat longer, centrally located urging piece 43 having a slight bend. The hinge spring 40 is secured by press fitting the mounting pieces 41 into the slits 21*a* of the spool 23. In this state the urging piece 43 of the hinge spring 40 urges the lower portion of the movable iron element 30 in the direction of the magnetic pole portion 25*a* from the back side of the iron element. As a result, the lower end portion of the movable iron element 30 is pressed against the end face 26*a* of the yoke 26.

Figure 10:
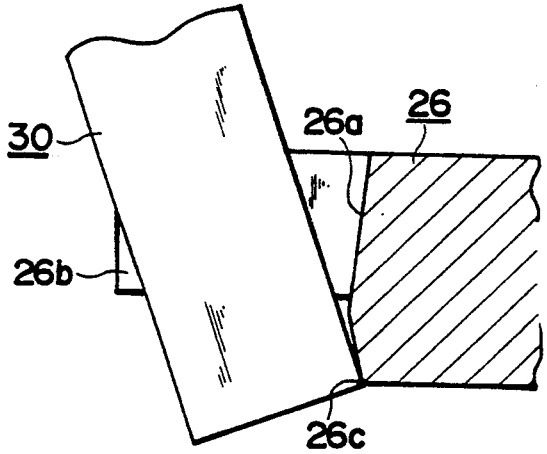
FIGS. 10 and 11 are enlarged sectional views for describing the operation of the movable iron element.
Figure 11:
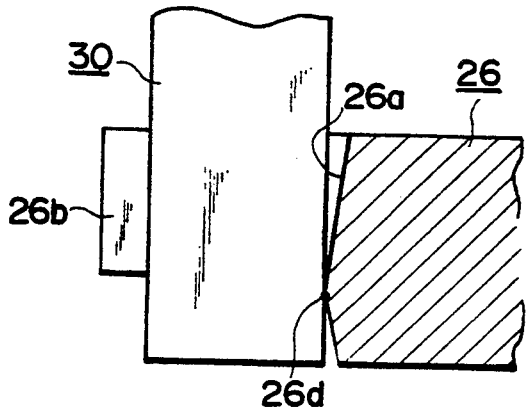

FIGS. 10 and 11 illustrate, in enlarged form, the lower end portion of the movable iron element 30 and the end face 26*a* of the yoke 26. The end face 26*a* of the yoke 26 is formed to have two inclined surfaces located one above the other so as to form a projection. When the movable iron element 30 is in a state in which the element is not being attracted by the magnetic pole portion 25*a*, the lower end portion of the movable iron element 30 is in contact with the lower edge (a first hinge point 26*c*) of the lower inclined surface of end face 26*a* (see FIG. 10). When the movable iron element 30 is erected from the inclined state to the approximately vertical state by being attached to the magnetic pole portion 25*a*, the lower end portion of the movable iron element 30 comes into contact with the ridge line (a second hinge point 26*d*) of the two inclined surfaces formed on the end face 26*a* (see FIG. 11). This turning motion of the movable iron element 30 is accompanied by a shift in the fulcrum of the turning motion from the first hinge point 26*c* to the second hinge point 26*d*, whereby it becomes possible to displace the movable iron element 30 by a weak attracting force, as will be described later.

Figure 14:
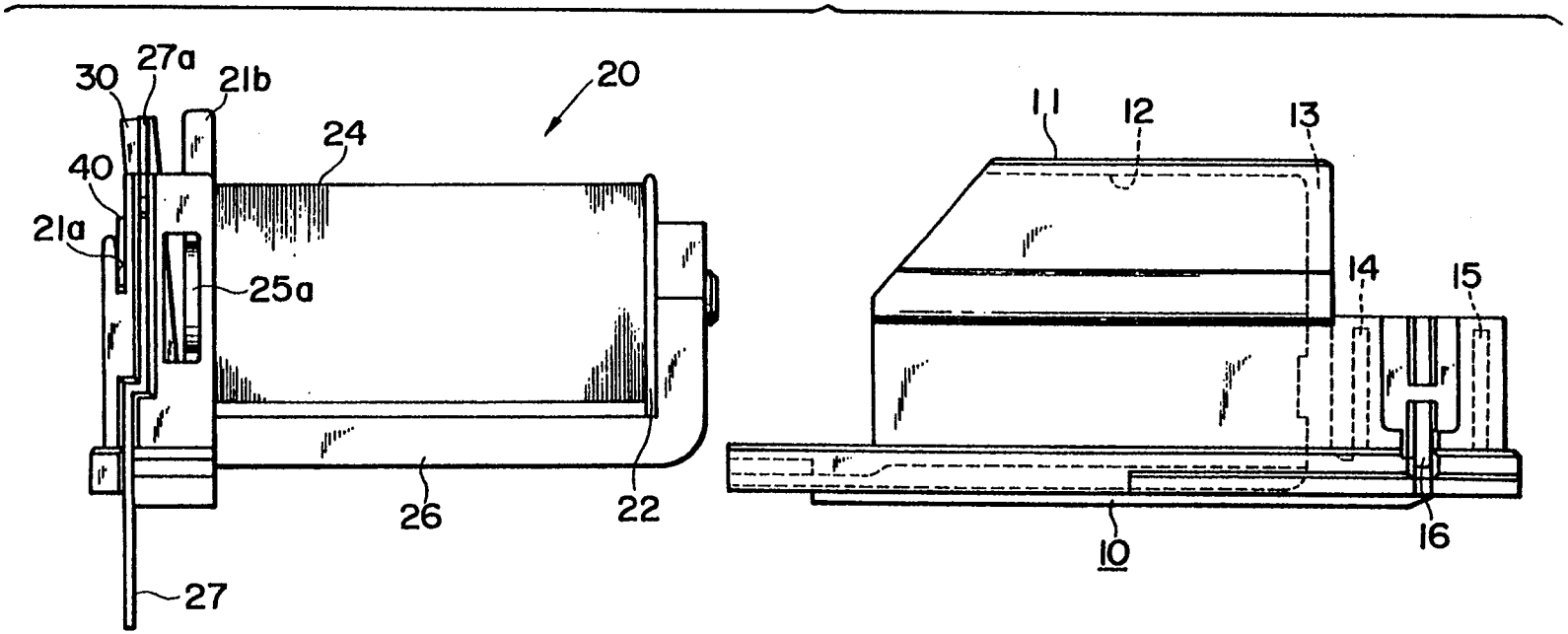
FIG. 14 is a side view showing the manner in which an electromagnet block is inserted into the base.

The electromagnet block 20 having the movable iron element 30 and hinge spring 40 attached to it in this manner is inserted into the space 12 within the base 10 from the opening of the frame 11, as shown in FIG. 14. In accordance with this embodiment, the arrangement is such that the hinge spring 40 is situated on the outer side of the movable iron element 30 and the urging piece 43 is situated at the lower part of the movable iron element 30. Accordingly, a dead space produced at the lower part of the movable iron element 30 is capable of being utilized effectively so that the apparatus can be made smaller in size.

Figure 15:
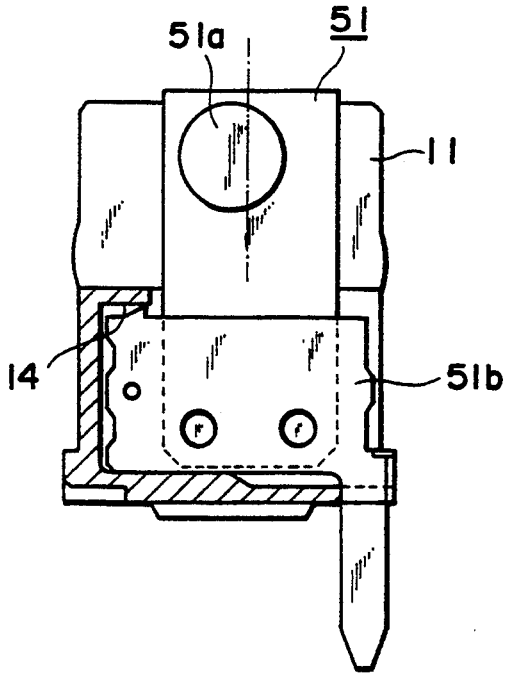
FIG. 15 is a side view showing a fixed contactor in an attached state.

The details of the fixed contactor 51 are illustrated in FIG. 15. The fixed contactor 51 has a fixed contact 51*a* on its upper part and a terminal piece 51*b* on its lower part. Similarly, the fixed contactor 52 has a fixed contact 52*a* on its upper part and a terminal piece 52*b* on its lower part. The fixed contacts 51*a*, 52*a* of the fixed contactors 51, 52 are provided on the sides of the fixed contactors that face each other. Further, the fixed contacts 51*a*, 52*a* are provided at positions slightly offset to one side of the fixed contactors 51, 52 relative to the center lines in the width direction thereof.

Figure 16:
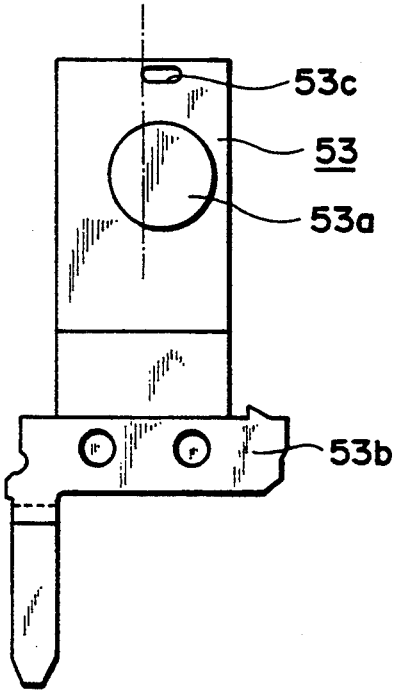
FIG. 16 is a front view of the movable contactor.

The details of the movable contactor 53 are illustrated in FIG. 16. The movable contactor 53 has movable contacts 53*a* on its upper part and a terminal piece 53*b* on its lower part. The movable contacts 53*a* are provided on both sides of the movable contactor 53 and are situated at locations slightly offset to one side of the movable contactor relative to the center line in the width direction thereof. A hole 53*c* is provided in the upper part of the movable contacts 53*a*.

The fixed contactors 51, 52 and the movable contactor 53 are secured by press fitting the terminal pieces 51*b*, 52*b* and 53*b* thereof into respective grooves 14, 15 and 16, which are formed in the base 10, from the sides of the base. As mentioned above, the fixed contacts 51*a*, 52*a* and the movable contact 53*a* are offset in opposite directions from the center lines of the contactors 51~53 (the center lines coincide with one another) (compare FIGS. 15 and 16). Accordingly, when the movable contact 53*a* makes or breaks contact with the fixed contact 51*a* or 52*a*, not only a bending moment but also a torsional moment acts upon the contactors 51~53. The contacts therefore exhibit an excellent anti-fusing property. Further, the substantial effective lengths of the contactors 51~53 are enlarged in comparison with a case in which the contacts are provided on the center lines, and therefore the lengths of the contactors 51~53 can be shortened correspondingly. This makes it possible to obtain an electromagnetic relay of small height.

Furthermore, since the contactors 51~53 are fixed by being press fitted into the grooves of the base 10 from the sides thereof, the contactors 51~53 can be increased in width, thereby making it possible to pass larger currents. The temperature rise will be small even if large currents are passed. In addition, since the fixed contactors 51, 52 and the movable contactor 53 are inserted into the base 10 from opposite sides thereof so that the terminal pieces 51*b*, 52*b* and the terminal piece 53*b* are located on opposite sides of the base 10, the insulating distance between these terminals can be lengthened.

Figure 17:
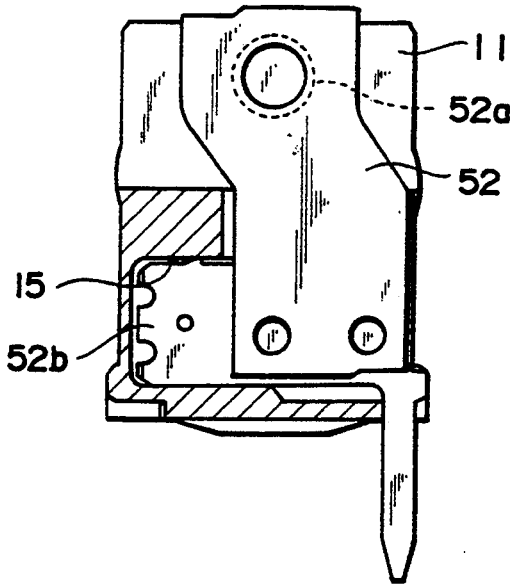
FIGS. 17 and 18 are sectional views each showing another example of a fixed contactor.
Figure 18:
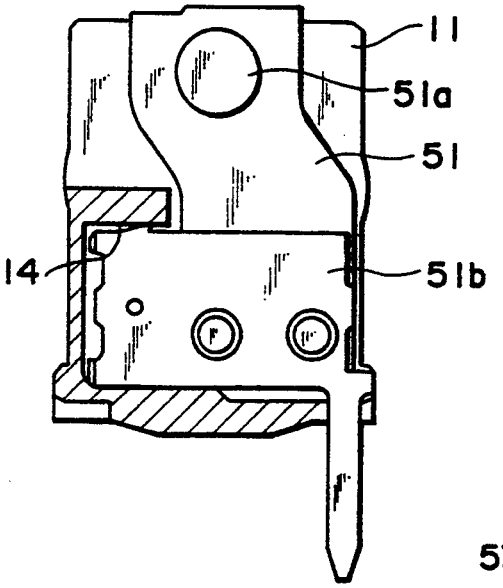
Figure 19:
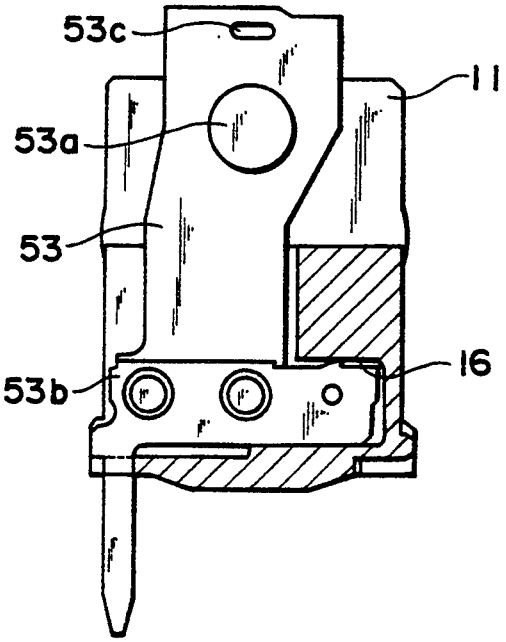
FIG. 19 is a sectional view showing another example of a fixed contactor.

The fixed contactors 51, 52 and the movable contactor 53 are not limited to perfectly straight (rectangular) shapes, as shown in FIGS. 15 and 16. It goes without saying that the edges of these contactors can have a curved shape, as illustrated in FIGS. 17 through 19. The shapes of the contactors can be determined with a view to cutting the contactors to a shape that will allow the plate-shaped material to be utilized as effectively as possible.

Figure 20:
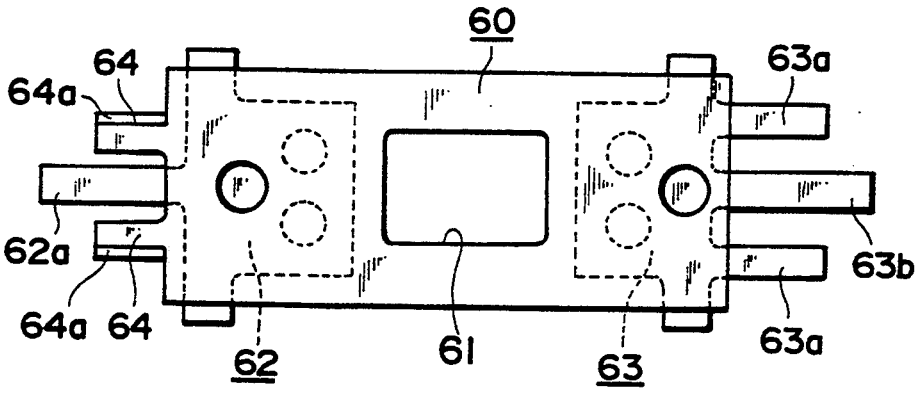
FIG. 20 is a plan view of a slide card.
Figure 21:
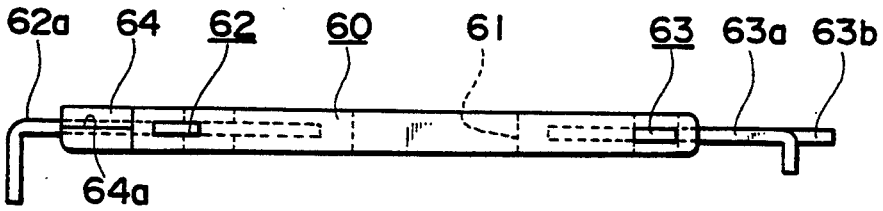
FIG. 21 is a side view of the slide card.

FIGS. 20 and 21 illustrate the details of the slide card 60. The slide card 60 is formed from a sheet, which is made of synthetic resin, having a substantially rectangular shape when viewed in the plane. A rectangular hole 61 is provided in the central portion of the card. Engaging fittings 62 and 63 are integrally secured to both edge portions of the slide card 60 by insert molding. Side pieces 64 each having a step portion 64*a* project from both side portions of the slide card 60 at one end thereof. An engaging finger 62*a* of the engaging fitting 62 extends at a position between the slide pieces 64, and the tip portion of the engaging finger 62*a* is bent downward. The engaging fitting 63 secured to the other edge portion of the slide card 60 has a slide piece 63*b* extending at the central portion thereof and is formed to include urging pieces 63*a* on both sides of the slide piece. The urging pieces 63*a* have their respective tip portions bent downward.

Since the engaging fitting 63 is formed to have the slide piece 63*b* and the urging pieces 63*a* that are separate from each other, it is easy to adjust the their lengths and the spacing between them. Further, since the tips of the urging pieces 63*a* are bent, they will not scratch the surface of the movable contactor 53 and wear fragments will not be produced. Only the engaging fitting 63 need be attached to the slide card 60, and the engaging finger 62*a* of the engaging fitting 62 may be integrally molded from a synthetic resin the same as that of the slide card 60.

Figure 22:
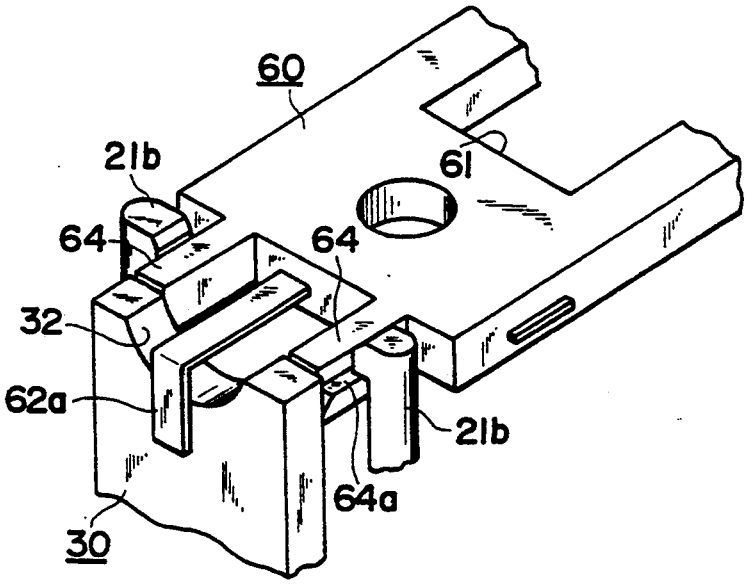
FIGS. 22 and 23 are perspective views each illustrating the state in which the slide card is attached.
Figure 23:
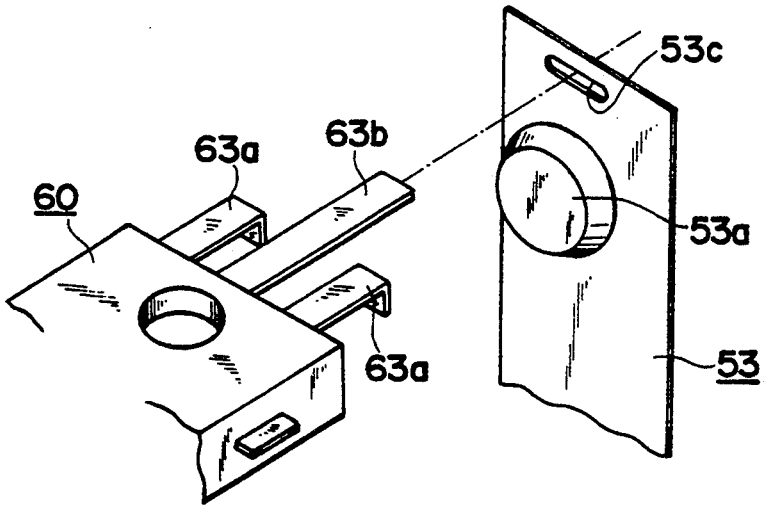
Figure 24:
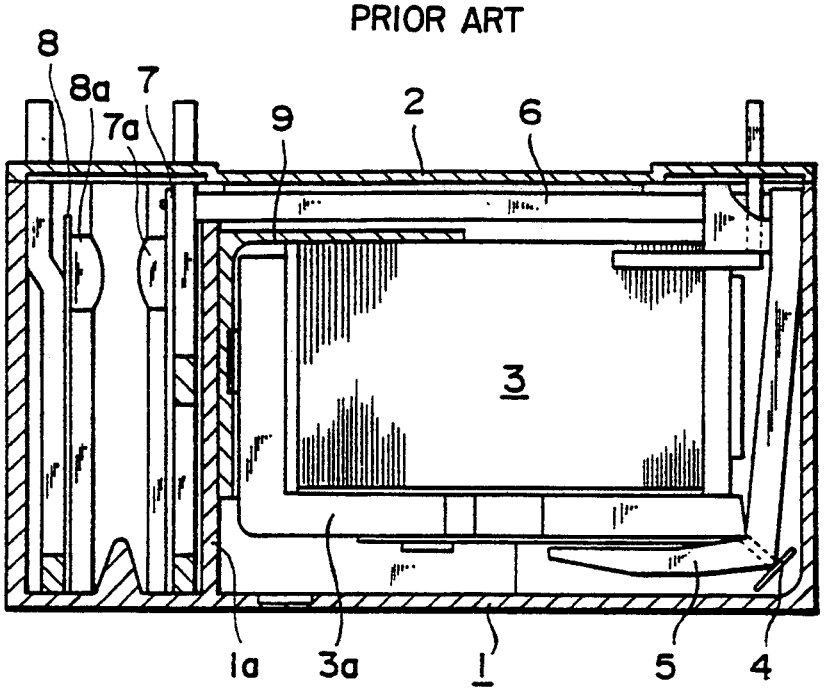
Fig. 24 PRIOR ART
FIG. 24 is a sectional view of an electromagnetic relay according to the prior art.
Figure 25:
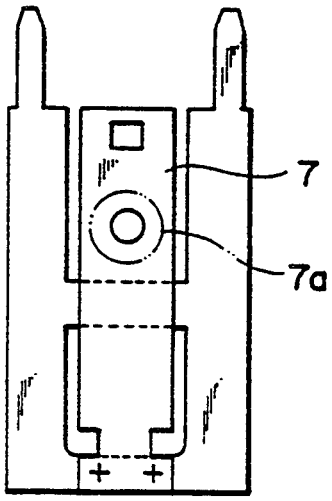
Fig. 25 PRIOR ART
FIG. 25 is a front view showing a movable contactor of the electromagnetic relay according to the prior art.

The slide card 60 is attached as shown in FIGS. 22 and 23 and is held so as to be capable of moving. The engaging finger 62*a* of the engaging fitting 62 is engaged, at one edge portion of the slide card 60, with the semicircular cut-out 32 at the upper end of the movable iron element 30, the slide pieces 64 are inserted inward between the guide projections 21*b* of the spool 23 and the guide projections 21*b* engage the step portions 64*a*. The distal-end faces of the slide pieces 64 abut against the upper portion of the movable iron element 30. At the other end portion of the slide guide 60, the slide piece 63*b* of the engaging fitting 63 enters the hole 53*c* of the movable contactor 53, and the urging pieces 63*a* come into contact with the upper portion of the movable contactor 53.

Since the engaging fittings 62 and 63 are insert molded on both end portions of the card 60, the card 60 will not readily experience thermal deformation and curvature. Further, since the card 60 is connected to the movable contactor 53 via the engaging fitting 63, wear fragments will not be produced from the resin portion, as occurs in the prior art, even when the card 60 is slid. Hence, faulty contact caused by such wear fragments does not occur. Furthermore, since the melting point of the engaging fitting 63 is high, the card 60 will not be melted by heat if such heat is produced by the movable contactor 53. Also, as will be apparent from the method of assembly described above, assembly is easier than in the prior art and productivity is improved as a result.

In FIG. 1, the case 70 is box-shaped and is capable of being fitted on the base 10. A projection 71 protrudes inwardly from the central portion of the upper side of the case. Furthermore, the case 70 is formed to have a gas venting hole 72 at a corner of the upper side thereof, and is provided with a protuberance 73 which, by being broken off, is capable of forming the gas venting hole for the purpose of venting nitric acid that evolves during use.

When the case 70 is fitted on the base 10 containing the electromagnet block 20, the lower end portion of the projection 71 abuts against the upper surface of the frame 11 of base 10 through a mating hole 61 of the card 60 (see FIG. 2). A sealing agent is injected into the base 10 to harden on the floor thereof, thereby forming a seal. After the gas in the interior has been vented from the gas venting hole 72, the latter is heated and fused to seal off the hole, thereby completing the operation for assembling the electromagnetic relay.

In accordance with the above-described arrangement, the upper side of the case 70 is supported on the frame 11 of the base 10 via the projection 71. Therefore, even if an external force is applied to the upper side of the case 70, the upper side of the case 70 will not flex and the sliding operation of the card 60 will not be impeded.

If the gate of a mold for molding the case 70 is disposed on the central axis of the projection 71, the flow of resin will be improved and moldability enhanced.

The invention is not limited to the arrangement in which the projection 71 of the case 70 is abutted against the upper surface of the frame 11 of base 10. Various modifications are possible. For example, it may be so arranged that the projection 71 abuts against part of the spool 23 of the electromagnet block 20, or the upper side of the frame 11 may be provided with a projection that is brought into abutting contact with the inner surface of the upper side of the case 70. Furthermore, by forming a cut-out in the card 60 rather than the hole 61, collision with the projection 71 may be avoided.

The operation of the electromagnetic relay having the foregoing construction will be described next.

If a current is not being passed through the coil 24 and, hence, the electromagnet block 20 is not being excited, the movable contactor 53 is urged leftward in FIG. 2 by its own spring force so that the movable contact 53*a* is in contact with the fixed contact 51*a* and spaced away from the fixed contact 52*a*.

When a current is passed through the coil 24 to excite the electromagnet block 20, the magnetic pole portion 25*a* of the core 25 attracts the movable iron element 30, as a result of which the movable iron element 30 begins to turn clockwise (see FIG. 10) with the first hinge point 26*c* serving as the fulcrum. In mid course, turning continues with the second hinge point 26*d* serving as the fulcrum (see FIG. 11). As a result, the upper end portion of the movable iron element 30 urges the distal-end surfaces of the slide pieces 64 provided on the card 60. Consequently, the card 60 moves rightward in FIG. 2 so that the urging pieces 63*a* of the card 60 urge the upper end portion of the movable contactor 53. As a result, the movable contactor 53 is flexed against its spring force so that the movable contact 53*a* separates from the fixed contact 51*a* and makes contact with the fixed contact 52*a*.

When feed of current to the coil 24 is halted to de-energize the electromagnet block 20, the movable contactor 53 is restored by its own spring force and the card 60 is pushed back so that the movable iron element 30 returns to its original position by turning in a direction opposite that mentioned above. The movable contact 53*a* separates from the fixed contact 52*a* and again makes contact with the fixed contact 51*a*.

The upper end (free end) of the movable iron element 30 is clamped firmly between the distal-end faces of the slide pieces 64 and the downwardly bent portion of the engaging finger 62*a* of the card 60 so that there is no gap between the movable iron element 30 and the distal end faces of the slide pieces 64 nor between movable iron element 30 and the engaging finger 62*a*. Consequently, the card 60 moves in unison with the movable iron element 30 when the latter is attracted by the core 25, and bouncing of contacts does not occur.

Figure 12:
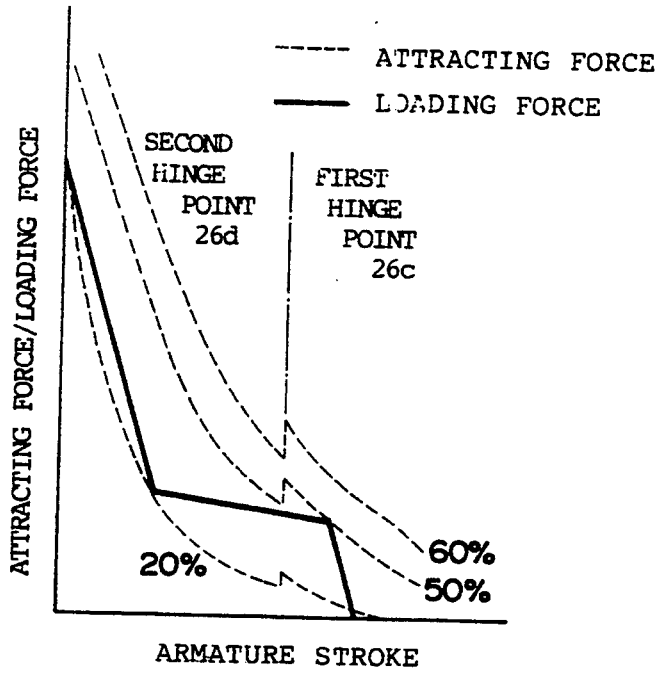
FIG. 12 is a graph showing an attracting-force/loading-force characteristic of an electromagnetic relay according to an embodiment of the invention.

As explained with reference to FIG. 10 and 11, the fulcrum of the movable iron element 30 shifts from the first hinge point 26*c* to the second hinge point 26*d* when the movable iron element 30 turns. As a consequence, in dependence upon the armature stroke, the attracting force characteristic varies discontinuously at the position where the fulcrum of rotation changes, as illustrated in FIG. 12. In FIG. 12, armature stroke indicates the amount of displacement of the upper end portion of the movable iron element 30, namely the amount of displacement of the card 60 or the upper end portion of the movable contactor 53. The attracting-force characteristic is indicated by the dashed lines, which prevail when the voltage impressed upon the coil 24 is 20%, 50% and 60% of the rated voltage. Loading force, which is indicated by the solid line, is that necessary to displace the upper end portion of the movable iron element 30, the card 60 and the upper end portion of the movable contactor 53. Since the attracting force under an applied voltage that is 50% of the rated voltage thus surpasses the loading force, the device is capable of operating sufficiently as an electromagnetic relay at an operating voltage that is 50% of the rated voltage.

Figure 13:
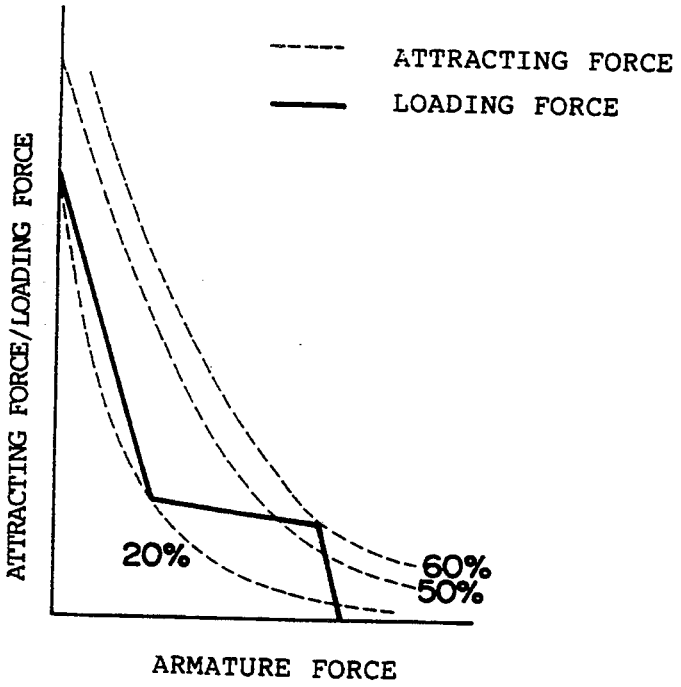
FIG. 13 is a graph showing an attracting-force/loading-force characteristic of an electromagnetic relay serving as an example for comparison.

By contrast, FIG. 13 illustrates the characteristics in a case where the end face 26*a* of the yoke 26 is formed to be flat, as a result of which the fulcrum of rotation of the movable iron element 30 does not move. With a structure of this kind, an operating voltage that is 60% of the rated voltage is required in order to operate the electromagnetic relay correctly.

Thus, by arranging it so that the first hinge point 26*c* can be utilized, the operating voltage is reduced from 60% to 50% of the rated voltage so that a large initial driving force is obtained at a low voltage. This makes it possible to reduce power consumption.

In the embodiment described above, it goes without saying that either of the fixed contacts 51, 52 can be deleted, depending upon the particular application.

Industrial Applicability

The electromagnetic relay according to the present invention is utilized as one type of control device in many control systems.

What is claimed is:

1. An electromagnetic relay having a movable piece supported so as to be free to oscillate, an electromagnet block for attracting and oscillatingly displacing said movable piece, a contact mechanism having a movable contactor and a fixed contactor, a connecting member connecting a free end of said movable piece and said movable contactor, a housing for internally accommodating each of these elements, and a supporting projection for assuring a space within which said connecting member is freely movable, said supporting projection formed on one of a face of said housing and a partial face of any element accommodated within said housing, which faces oppose each other with said connecting member interposed between them in spaced relation thereto, said supporting projection in abutting contact with the other of said faces, said connecting member having an avoiding shape formed therein such that, despite movement of said connecting member along a longitudinal direction thereof, said connecting member avoids said supporting projection without contacting said supporting projection, said avoiding shade being at least one of a hole and a cut-out.

2. An electromagnetic relay having a movable piece supported so as to be free to oscillate, an electromagnet block for attracting and oscillatingly displacing said movable piece, a contact mechanism having a movable contactor and a fixed contactor, a connecting member connecting a free end of said movable piece and said movable contactor, a housing for internally accommodating each of these elements, and a supporting projection for assuring a space within which said connecting member is freely movable, said supporting projection formed on one of a face of said housing and a partial face of any element accommodated within said housing, which faces oppose each other with said connecting member interposed between them in spaced relation thereto, said supporting projection in abutting contact with the other of said faces, said connecting member having an avoiding shape formed therein such that, despite movement of said connecting member along a longitudinal direction thereof, said connecting member avoids said supporting projection without contacting said supporting projection, said avoiding shape being at least one of a hole and a cut-out, wherein said electromagnet block includes a yoke, and a lower end portion of said movable piece is supported, so as to be free to oscillate, on a distal end portion of the yoke, one face at the lower end portion of said movable piece is in contact with a distal-end face of said yoke, the distal-end face of said yoke is formed to have at least one inclined surface, and a lower edge and an upper edge of the inclined surface are so adapted as to act as fulcrums of oscillation of said movable piece.

3. An electromagnetic relay according to claim 1, wherein said electromagnet block includes a spool having walls on both sides of a front face thereof, and a yoke, said movable piece is disposed between both of said walls and is supported at its lower end portion, so as to be free to oscillate, on a front end portion of said yoke, and a hinge spring having an urging piece for urging said movable piece from a back side thereof, is attached to an upper portion of both side walls of said spool.

4. An electromagnetic relay according to claim 1, wherein said movable contactor has a movable contact, said fixed contactor has a fixed contact and said fixed contact and said movable contact are provided at positions slightly offset from each other in a direction perpendicular to length directions of both said movable and fixed contactors.

5. An electromagnetic relay according to claim 1, wherein an engaging fitting for connecting the slide card to said movable contactor is provided on one end of said slide card.

6. An electromagnetic relay according to claim 5, wherein said slide card is made of a synthetic resin.

7. An electromagnetic relay according to claim 5, wherein said engaging fitting is secured to said slide card by insert molding.

8. An electromagnetic relay according to claim 5, wherein an engaging fitting for connecting said slide card to said movable piece is provided on the other end of said slide card.

* * * * *

UNITED STATES PATENT AND TRADEMARK OFFICE

CERTIFICATE OF CORRECTION

PATENT NO. : 5,396,204

DATED : March 7, 1995

INVENTOR(S) : Kazushige MATSUOKA et al.

It is certified that error appears in the above-indentified patent and that said Letters Patent is hereby corrected as shown below:

In Column 10, line 1, change "shade" to --shape--.

Signed and Sealed this

Twenty-fourth Day of June, 1997

Bruce Lehman

*Attest:*

BRUCE LEHMAN

*Attesting Officer*

*Commissioner of Patents and Trademarks*